US006761491B2

(12) United States Patent
Hall

(10) Patent No.: US 6,761,491 B2
(45) Date of Patent: Jul. 13, 2004

(54) PHOTOGRAPHIC PROCESSOR AND SUPPLY CARTRIDGE WITH AN INFORMATION EXCHANGE ARRANGEMENT

(75) Inventor: Jeffrey L. Hall, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/314,686

(22) Filed: Dec. 9, 2002

(65) Prior Publication Data

US 2004/0109682 A1 Jun. 10, 2004

(51) Int. Cl.[7] ..... G03D 3/02

(52) U.S. Cl. ..... 396/567; 396/568; 396/570; 396/626; 396/27

(58) Field of Search ..... 396/567–570, 396/620, 626; 355/27–29; 134/64 P, 64 R

(56) References Cited

U.S. PATENT DOCUMENTS

| | | | | |
|---|---|---|---|---|
| 5,043,756 A | | 8/1991 | Takabayashi et al. | |
| 5,353,083 A | | 10/1994 | Rosenburgh et al. | |
| 5,355,190 A | | 10/1994 | Rosenburgh et al. | |
| 5,389,994 A | | 2/1995 | Rosenburgh et al. | |
| 5,418,592 A | | 5/1995 | Patton et al. | |
| 5,604,559 A | * | 2/1997 | Yamanouchi et al. | 396/578 |
| 5,864,729 A | | 1/1999 | Piccinino, Jr. et al. | |
| 5,890,028 A | | 3/1999 | Nomura et al. | |
| 5,960,227 A | | 9/1999 | Kurokawa et al. | |
| 6,082,908 A | | 7/2000 | Tumidei | |
| 6,173,119 B1 | | 1/2001 | Manico et al. | |
| 6,505,979 B2 | | 1/2003 | Twist et al. | |
| 6,508,597 B2 | | 1/2003 | Freidhoff et al. | |

OTHER PUBLICATIONS

Robert Spur, An Imaging Apparatus Capable of Forming An Image Consistent with Type of Imaging Consumable Loaded Therein and Method of Assembling the Apparatus; USSN 09/334,021 filed Jun. 16, 1999.

* cited by examiner

*Primary Examiner*—D. Rutledge
(74) *Attorney, Agent, or Firm*—David A. Novais

(57) ABSTRACT

The present invention relates to a method and use of information exchange between processing solution supply cartridges that are placed on a small processing machine and a controller that is used to operate the machine. In a feature of the present invention, the controller is adapted to control the operation of the processing machine based on the residual volume of processing solution in the cartridge. That is, the controller is adapted to compare the residual volume of processing solution in the supply cartridge to the amount of processing solution needed to process a specific roll of loaded film and control processing accordingly.

24 Claims, 3 Drawing Sheets

PHOTOGRAPHIC PROCESSOR AND SUPPLY CARTRIDGE WITH AN INFORMATION EXCHANGE ARRANGEMENT

FIELD OF THE INVENTION

The present invention relates to an information exchange arrangement between a photographic supply cartridge and a photographic film processor. The information exchange is used to verify that the actual volume of solution within the solution cartridge is adequate to process photographic film which is loaded on the processor.

BACKGROUND OF THE INVENTION

Small volume batch processors, whether run by an operator or a free standing customer oriented entity such as kiosk, have to have consumables available in order to process the next customer order. This is true for any batch processor. More specifically, a small volume photographic processing unit such as a batch processor that requires processing chemicals to convert an exposed image into a developed image could run out of chemistry before the processing of the photographic element is completed. In batch processors, failure to have sufficient chemical volumes available to process the film once film processing is commenced can lead to catastrophic loss of the exposed images.

As an example, ink jet printers can run out of ink before an order is complete, causing frustration on the part of the user. However, in ink jet printers, the images that were to be printed at the time when the printer ran out of ink, can be resent to the printer after the consumables are replaced without adverse affect to the images.

Generally, large film processors such as those available in centralized photofinishing operations or in distributed photofinishing operations such as minilabs use large volumes of processing solution, often greater than 20 liters in total for all of the processing solutions. These photofinishing operations typically use a replenishment system. Such a replenishment system replaces the amount of a given functional solution such as a developer that gets consumed by the film with a small volume of more concentrated solution of the same functionality. The actual volume used of the more concentrated functional solutions depends on the area of film that is being processed (film length by film width). Typically, the replenishment rate is expressed in linear feet for a given film format rather than film area, with one set of conditions for 35 mm type film, another for APS-type film, and others for 110-format-type film and 126-format-type film. These replenishment solutions are also used to replace any evaporative losses associated with a given functional solution. The intent is to keep the concentration of the active solution components at specified aim concentrations plus or minus the noise factors present in such a replenishment system. Thus, the ratio of actual tank solution volume for a functional processing solution to the replenishment solution volume needed to process even the largest area of film is very large. In such instance, if the replenishment volume is insufficient to process the customer's order, processing can still continue without lost images in the functional solution volume that is available. An alarm is likely to be used to signal the operator of such a replenished system to replace the spent replenishment solution volume.

However, for a small volume processing machine such as a batch processor that uses cartridges to supply the needed functional solutions, the ratio of actual tank solution volume for a functional processing solution to the replenishment solution volume needed to process even the largest area of film may be very small including zero. In such instances, processing a customer's roll of film can lead to a catastrophic loss of images if the volume of functional solution available is insufficient to complete the desired processing cycle. There is a need for a small volume processor that recognizes that the residual functional volume in a supply cartridge is insufficient to complete the next customer's order to avoid catastrophic loss of recorded images.

SUMMARY OF THE INVENTION

The present invention relates to a method and use of information exchange between supply cartridges that are placed on a small processing machine and the control program used to operate the processing machine. A preferred element of the information that is exchanged is the volume of functional solution present in the supply cartridge. A further element of the information exchange can be a verification that the correct solution is placed within the film processor. A still further element of the information exchange is a secure identification that ensures that only functional solutions of a certain type or from a certain manufacturer are used within the film processor in order to ensure the quality of the processed images.

The present invention accordingly relates to a method of processing photographic material which comprises the steps of loading a processing solution cartridge onto a processing machine; transferring first information indicative of a residual volume of processing solution in the cartridge to the processing machine; loading a film to be processed onto the processing machine; transferring second information about the loaded film to be processed to the processing machine; determining a volume of processing solution needed to process the loaded film based on the transferred second information; dispensing the volume of processing solution needed to process the loaded film into the processing machine to process the loaded film; adjusting the residual volume of processing solution in the cartridge by subtracting the dispensed volume of processing solution from the residual volume to provide for an adjusted residual volume; and updating the first information based on the adjusted residual volume.

The present invention therefore relates to a method of processing photographic material which comprises the steps of loading a processing solution cartridge onto a processing machine; transferring first information indicative of a residual volume of processing solution in the cartridge to the processing machine; loading a film to be processed onto the processing machine; transferring second information about the loaded film to be processed to the processing machine; determining a volume of processing solution needed to process the loaded film based on the transferred second information; and determining if the residual volume of processing solution in the cartridge is greater than or equal to the volume of processing solution needed to process the loaded film. In the method of the present invention, if the residual volume of processing solution in the cartridge is greater than or equal to the volume of processing solution needed to process the loaded film, the method further comprises the step of dispensing the volume of processing solution needed to process the loaded film into the processing machine to process the loaded film. If the residual volume of processing solution in the cartridge is less than the volume of processing solution needed to process the loaded film, the method further comprises the step of rejecting a processing operation of the loaded film by not dispensing processing solution into the processing machine.

The present invention further relates to a processing system that comprises a processing machine for processing photographic film therein, with the processing machine having a code reader; a control system for controlling operation of the processing machine, with the control system being adapted to at least determine a volume of processing solution needed to process a unit amount of photographic film which is to be processed in the processing machine; and a solution supply cartridge for supplying processing solution to the processing machine to process the photographic film. The cartridge has a code thereon which includes information indicative of a residual volume of processing solution in the cartridge, such that an association of the supply cartridge with the processing machine permits the code reader on the processing machine to read the code on the supply cartridge to cause a transfer of the information indicative of the residual volume of processing solution in the cartridge to the control system. The control system of the invention is further adapted to dispense the volume of processing solution needed to process the unit amount of film to be processed in the processing machine if the residual volume of processing solution in the cartridge is greater than or equal to the volume of processing solution needed to process the unit amount of film to be processed in the processing machine; and reject a processing operation of the unit amount of film by not dispensing processing solution into the processing machine, if the residual volume of processing solution in the cartridge is less than the volume of processing solution needed to process the unit amount of film.

The present invention further relates to a method of processing photographic material which comprises the steps of loading a processing solution cartridge onto a processing machine; transferring first information indicative of residual volume of processing solution in the cartridge to the processing machine; loading a film to be processed onto the processing machine; transferring second information about the loaded film to be processed to the processing machine; determining a volume of processing solution needed to process the loaded film based on the transferred second information; and controlling a processing of the loaded film in the processing machine based on the volume of processing solution needed to process the loaded film.

The present invention further relates to a processing system which comprises a processing machine for processing photographic film therein, with the processing machine having a code reader; a control system for controlling operation of the processing machine, with the control system being adapted to at least determine a volume of processing solution needed to process a unit amount of photographic film which is to be processed in the processing machine; and a solution supply cartridge for supplying processing solution to the processing machine to process the photographic film, with the cartridge having a code thereon which includes information indicative of a residual volume of processing solution in the cartridge, such that an association of the supply cartridge with the processing machine permits the code reader on the processing machine to read the code on the supply cartridge to cause a transfer of the information indicative of the residual volume of processing solution in the cartridge to the control system. The control system is further adapted to control a processing of the film in the processing machine based on the volume of processing solution needed to process the unit amount of film in the processing machine.

The present invention also relates to a method of processing photographic material which comprises the steps of loading a processing solution cartridge onto a processing machine; transferring first information indicative of a residual volume of processing solution in the cartridge to the processing machine; loading a film to be processed into the processing machine; and transferring second information about the loaded film to be processed to the processing machine. In the method of the present invention, if the residual volume of processing solution in the cartridge is greater than or equal to the volume of processing solution needed to process a longest length of loaded film that uses a highest replenishing rate, then the method further comprises dispensing the needed volume of processing solution. If the residual volume of processing solution in the cartridge is less than the volume of processing solution needed to process the longest length of loaded film that uses the highest replenishing rate, the method further comprises the step of rejecting a processing operation of the loaded film by not dispensing processing solution into the processing machine.

The present invention also relates to a method of processing photographic material which comprises the steps of: loading a processing solution cartridge onto a processing machine; transferring information indicative of a residual volume of processing solution in the cartridge to the processing machine; and determining a volume of processing solution needed to process a hypothetical film length based on a film which is to be loaded on the processing machine. In the method of the present invention, if the residual volume of processing solution in the cartridge is greater than or equal to the determined volume of processing solution, then the processing machine awaits a film to be loaded for processing, and if the residual volume of processing solution in the cartridge is less than the determined volume of processing solution, the method further comprises the step of rejecting a processing operation of the film.

DETAILED DESCRIPTION OF THE INVENTION

Figure 1:
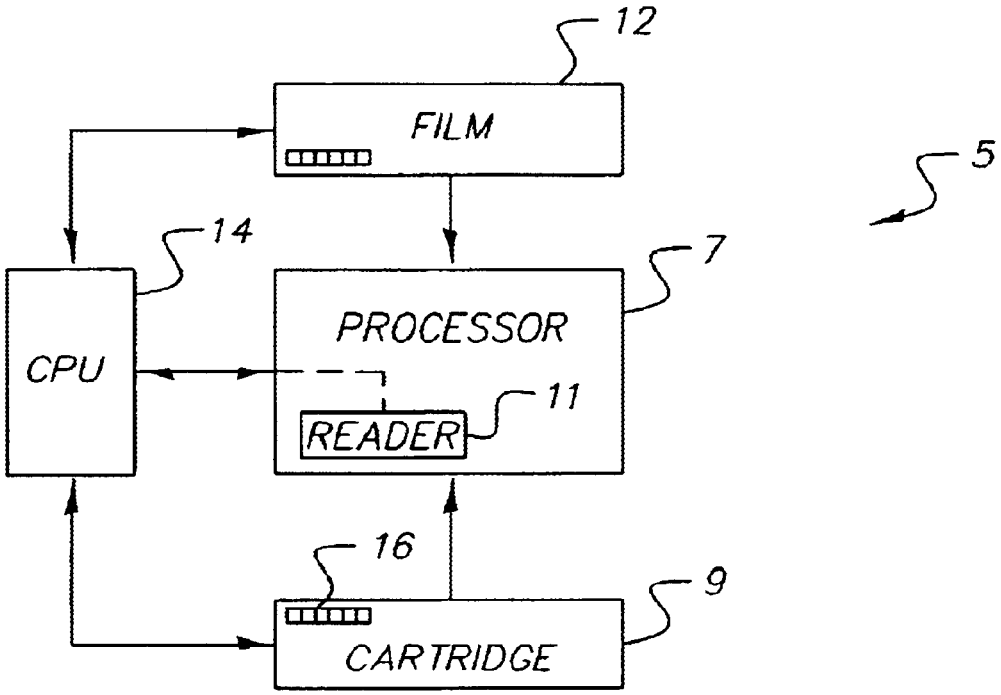
FIG. 1 schematically illustrates a processing system in accordance with the present invention.

Referring now to the drawings, FIG. 1 schematically illustrates a processing system 5 in accordance with a feature of the present invention. As shown in FIG. 1, processing system 5 includes a processing machine or processor 7. Processing machine 7 could be any of a variety of known small volume processing arrangements such as batch processors, and can optionally be plumbingless. A solution supply cartridge 9 schematically shown in FIG. 1 is adapted to be attached to or associated with processing machine 7 so as to supply processing solution to processing machine 7. The solutions can be known solutions utilized during the processing of photographic material, such as bleach solution, developer solution, fixer solution, etc. Functional solutions are typically supplied to small volume processing machines using a cartridge delivery system such as solution supply cartridge 9. Cartridge 9 can be a known cartridge which is adapted to hold solution therein and be fluidly connected to a processor or processing machine via valves. Cartridge 9 can further include a waste compartment or container for collecting waste solution. As an example, cartridge 9 can be a cartridge having compartments and/or containers dedicated to a specific processing solution, and optionally waste solution, with valves which cooperate with corresponding valves in processing machine 7, such as disclosed in U.S. Pat. No. 6,520,693 issued Feb. 18, 2003 entitled A METHOD OF PROVIDING PHOTOPROCESSING SERVICES, U.S. Pat. No. 6,468,722 issued Oct. 22, 2002 entitled A PHOTOFINISHING PROCESSING SYSTEM AND A PROCESSING SOLUTION SUPPLY CARTRIDGE FOR THE PROCESSING SYSTEM and U.S. Pat. No. 6,645,708 issued Nov. 11, 2003 entitled A PHOTOFINISHING PROCESSING SYSTEM AND A PROCESSING SOLUTION SUPPLY CARTRIDGE FOR THE PROCESSING SYSTEM.

As shown in FIG. 1, processing machine 7 includes a code reader 11 which is adapted to read, for example, RF identification codes, barcodes, etc. For a bar code reader, a ray of light such as laser light is emitted onto the bar code which is attached to cartridge 9 by printing directly onto the cartridge package or by printing to a label that is affixed to the cartridge package or any like method. Thus the bar code reader scans the bar code attached to the cartridge and the laser light reflected by the bar code is detected to read the bar code as described, for example, in U.S. Pat. No. 6,462,880. Another method to encode the necessary information is though the use of radio-frequency transponders that are widely available in a variety of forms such as those of Texas Instruments, Incorporated located in Dallas, Tex. These devices include a non-volatile memory such as an EEPROM (Electrically Erasable Programmable Read-Only Memory) semiconductor component integrally contained in the transponder. Stored in the non-volatile memory are encoded data. One such identification transponder is an inlay transponder. Such a transponder has a substantially flat shape. The antenna for an inlay transponder is in the form of a conductive trace deposited on a non-conductive support. The antenna has the shape of a flat coil or the like. Leads for the antenna are also deposited, with non-conductive layers interposed as necessary. Memory and any control functions are provided by a chip mounted on the support and operatively connected through the leads to the antenna. Reader 11 can then be a transceiver such as "Model S2000" transceiver available from Texas Instruments, Incorporated.

Cartridge 9 includes an identification code 16 thereon, such as a barcode, positioned in a manner such that when cartridge 9 is associated with processing machine 7, reader 11 will read identification code 16 from cartridge 9. Identification code 16 includes at least information with respect to the type of solutions within cartridge 9, as well as the volume of individual solutions within cartridge 9 or the entire solution volume within cartridge 9.

Also schematically shown in FIG. 1 is photographic film 12 which could be delivered in the form of a cartridge to processing machine 7. Associated with film 12 is film identification 20 which is, for example, a barcode or RF identification code such as described in U.S. Pat. No. 6,173,119 and references cited therein which contains information with respect to at least the film format and the film length of the film to be loaded. A controller or central processing unit (CPU) 14 can be integrated with processing machine 7 or can be a stand-alone CPU. CPU 14 is adapted to receive information with respect to film 12 and cartridge 9 and control processing machine 7 accordingly.

Therefore, when utilizing processing system 5 as shown in FIG. 1, a user would load processing solution cartridge 9 onto processing machine 7. Cartridge 9 includes code 16 which contains information such as the volume of functional solution in cartridge 9, a verification to confirm that the correct solution is placed within processing machine 7, and further information such as an identification of the solution type and the manufacturer. In a preferred embodiment, when cartridge 9 is loaded on processing machine 7, first information indicative of a residual volume of processing solution in cartridge 9 is transferred to processing machine 7 due to the fact that reader 11 reads code 16. This information is transferred to CPU 14. Also, when film 12 is loaded onto processing machine 7, CPU 14 or processing machine 7 would be adapted to read film identification 20 to at least determine the film format, film length or unit amount of film 12 to be processed.

Having the above-noted information, CPU 14 is adapted to determine a volume of processing solution needed to process loaded film 12 based on the film information of film 12. More specifically, based on the film format, film length or unit amount of film 12, CPU 14 would accordingly know how much processing solution needs to be supplied to processing machine 7 to process the loaded film.

Also, based on the above information, CPU 14 is further adapted to determine if the residual volume of processing solutions in cartridge 9 (i.e., the volume of developer solution, the volume of bleach solution, the volume of fix solution, etc.) is greater than and equal to the volume of processing solution needed to process loaded film 12. If the residual volume of processing solution in cartridge 9 is greater than or equal to the volume of processing solution needed to process loaded film 12, CPU 14 is adapted to control processing machine 7 and cartridge 9 to dispense the volume of processing solution needed to process the loaded film into the processing machine. If the residual volume of the processing solution in the cartridge is less than the volume of processing solution needed to process the loaded film, then CPU 14 controls processing machine 7 to reject a processing operation of loaded film 12 by not dispensing the processing solution into processing machine 7. At this point, an alarm can be sounded to notify an operator that a new cartridge 9 needs to be loaded onto processor 7.

Accordingly, with the system and method of the present invention, it is possible to prevent the initiation of a new processing cycle if there is not enough processing solution in cartridge 9 to process loaded film 12.

In a further feature of the present invention, after the appropriate amount of solution is dispensed into processing machine 7, assuming that there is enough solution in cartridge 9 to process loaded film 12, CPU 14 is adapted to adjust the value for the residual volume of the processing solution in cartridge 9 by subtracting the dispensed volume of processing solution from the residual volume of processing solution to provide for an adjusted residual volume of processing solution. This process continues until the residual volume of solution in cartridge 9 is not enough to process the specifically loaded film.

The processing chemistry or solution in cartridge 9 could be (1) supplied as tablet chemicals that are diluted to provide the desired processing formulations; (2) supplied as concentrates that are then diluted, or (3) supplied directly as working solutions. Any water needed to dilute the tablets or the concentrates must be supplied to the processing machines along with the processing chemistry or solution. Additionally, any water used to wash or rinse the processed film prior to the film being dried must also be supplied.

The volume of each solution in the freshly installed cartridge 9 is either manually entered in the processing machine's computer control system 14 (CPU) or is automatically entered as the cartridges are loaded into processing machine 7. Automatic information transfer between reader 11 and identification 16 can be accomplished using known devices such as two-dimensional or three-dimensional bar-code scanners; a magnetic strip reader, a radio-frequency transducer or any other like means. The automatic information transfer can include, besides each fresh solution residual volume, such information as solution, lot numbers, cartridge fill dates, usability code, and other pertinent information that might be recorded as part of a quality assurance plan. The supplied information could also be a URL (Universal Resource Locator) that identifies the supplier of cartridge 9. The processor hardware can then link to this URL and, among other items of information exchange, verify the authenticity of the package chemistry and download from this site the actual solution volumes associated with the cartridge now loaded on the processing machine.

A processing request is received when film 12 is available for processing. The film format and the film length are two parameters that are used to calculate the amount of solution needed to process the film. This information which relates to the unit amount of film to be processed can be provided in film identification 20. This information can also be captured directly from the film DX code if it is read automatically or can be entered into CPU 14 or processing machine 7 manually. The amount of each functional solution required to process the film is calculated using the common practice of multiplying a functional solution's replenishment rate by the linear feet of film that is to be processed. CPU 14 then controls processing machine 7 and cartridge 9 to dispense the solution volume as appropriate, into the tank or tanks of processing machine 7 for each functional processing sequence while the film is processed.

The calculated volume for each functional solution is used by the processing machine's computer control system (CPU 14) to manage the cartridge solution inventories. The residual volume left in cartridge 9 is the supply volume for each functional solution reduced by the volume of that solution used to process the film. Thus, the inventory of the functional solution is reduced as film is processed, this reduction being dependent on the film format, the film length and the film's replenishment rate for that functional solution.

This residual volume can then be compared to the actual unit amount of film loaded onto the processing machine; or can be compared to the volume needed to process a hypothetical film order that is defined to be the longest length of film that uses the highest replenishing rate. If the residual volume is less than the volume needed to process this hypothetical film order or the unit amount of loaded film, then the processing machine rejects any subsequent order for a, for example, kiosk-like operation or signals an operator to replace the now used cartridge with a fresh one. In other words, processing stops until consumables are replaced. If the residual volume is greater than or equal to the volume needed to process the hypothetical film order or the unit amount of loaded film, then the residual volume is defined to be the new supply volume and the process is ready to process another film order. This cycle continues until the residual volume is less than the volume needed to process the hypothetical film order or the unit amount of loaded film.

Figure 2A:
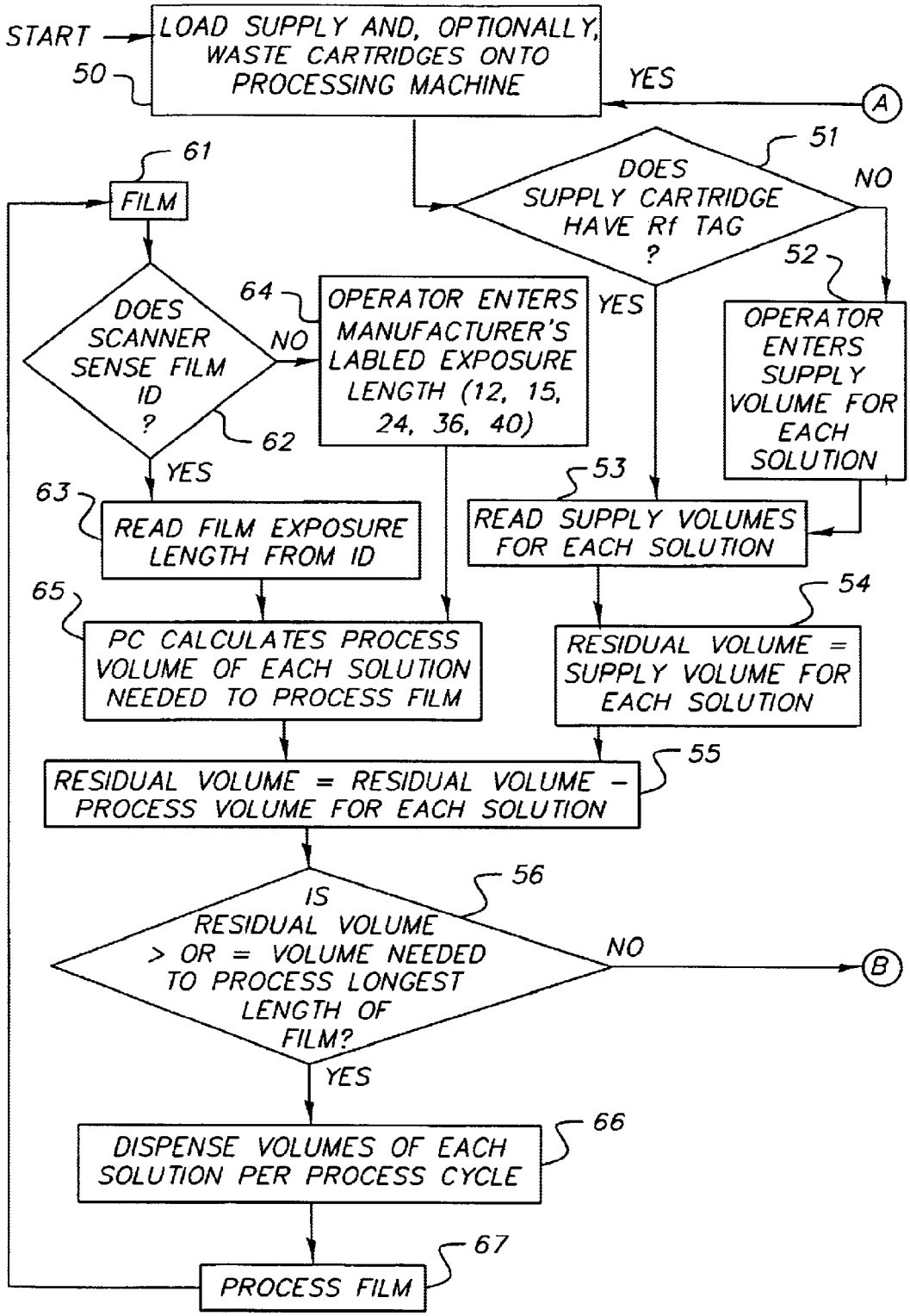
FIGS. 2A and 2B represent a flow chart detailing an operation with respect to the method and system of the present invention.
Figure 2B:
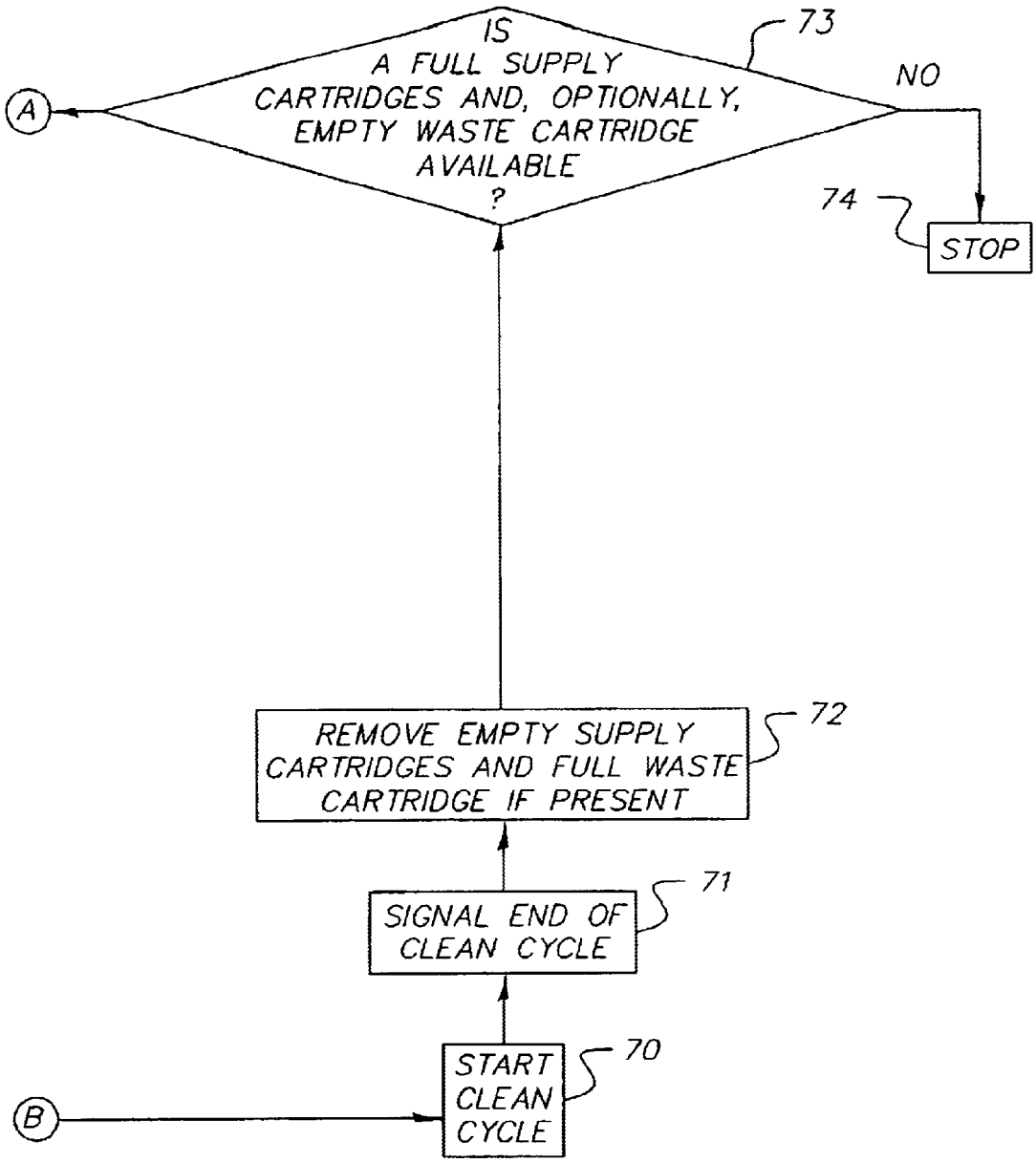
Figure 2:
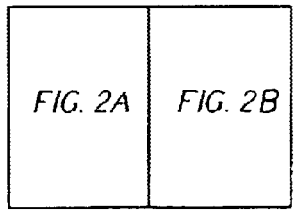

An operation of the system and method of the present invention is schematically illustrated in the flow chart of FIGS. 2A and 2B. With reference to FIGS. 2A and 2B, at step 50, the process is started by loading supply cartridge 9, and optionally, an integral waste cartridge onto machine processing 7. At step 51, CPU 14 is adapted to determine if supply cartridge 9 has a RF tag or another kind of identifying means (identification code 16). If the answer to step 51 is "no", the operator enters the supply volume for each solution in the cartridge manually. If the answer to step 51 is "yes", CPU 14 is adapted to control machine processing 7 and specifically, at step 53, reader 11 in machine processing 7 reads code 16 of cartridge 9 which includes information about supply volumes for each solution. At step 54, CPU 14 sets the value of the residual volume in cartridge 9 as the supply volume for each solution, that is, the residual volume used in the internal calculations of CPU 14 is set equal to the supply volume for each solution when a fresh cartridge 9 is loaded onto machine processing 7. In step 55, the residual volume can be adjusted by subtracting the process volume for each solution from the residual volume noted in step 54.

Along with the reading of the information with respect to the residual volume as noted in steps 50, 51, 52, 53, 54 and 55, film 12 is loaded onto processing machine 7 (step 61). In one embodiment, when the film is loaded, a scanner in processing machine 7 or CPU 14 determines if there is a film identification 20 on the film (step 62). If the answer is "yes", the film exposure length is read (step 63). If the answer is "no" to step 62, an operator can enter the manufacturer's label exposure length. At that point, CPU 14 is adapted to calculate the process volume of each solution needed to process the loaded film (step 65), and this information is used by CPU 14 to determine if there is enough residual volume of solution in the supply cartridge 9 to process the loaded film (step 56). If the answer to step is 56 "no", then it is concluded that there is not enough solution in supply cartridge 9 to process the loaded film. At that point, a clean cycle or process can be started (step 70). The clean cycle or process can involve a manual cleaning of the cartridges and/or the processing machine or an automated cleaning which may include a supply of washing solution from a washing solution source to the cartridge and/or processing machine. Thereafter, a signal or indication is given at the end of the clean cycle or process (step 71) and the empty supply cartridge and full waste cartridges (if provided) can be removed (step 72). It is then determined if full supply cartridges and optionally empty cartridges are available to be loaded back to processing machine 7 (step 73). When the supply cartridge is removed from machine processing 7, the identification code 16 is altered or rendered unreadable such that reader 11 used in step 53 can no longer read the cartridge identification code 16. In so doing, loading an empty cartridge or an improperly handled cartridge is avoided. The step of making the identification code or information unreadable can be achieved by providing a marking device to write over the bar code; providing a defacing device such as a knife to score the bar code label 16 on cartridge 9 thus rendering it unreadable; or providing a RF transceiver to overwrite the RF transponder. Otherwise, the processing operation is terminated (step 74).

If the answer to step 56 is "yes", the process proceeds to step 66 where the volumes of each process solution per process cycle is dispensed, and the loaded film is processed (step 67). After step 66 and 67, the present invention is adapted to continue a cycle by way of steps 61, 62, 63, 64 and 65 and steps 55 and 56 for the next film to be processed. As each film is processed, the residual volume value is adjusted or updated by continuously deducting the amount of processing volume for each solution that has been dispensed to the processing machine until the residual volume is less than the volume needed to process the loaded film. At that point, the answer to step 56 would be "no", and the method would proceed with the cartridge replacement cycle as noted in steps 70, 71, 72, 73 and 74.

In a further embodiment of the present invention, it is noted that it is not necessary to load the processing machine with film or measure or read the unit amount of the loaded film to be processed to determine if processing can be performed as described above. More specifically, in this further embodiment, it is possible to use a hypothetical film order (based on the film to be loaded or the loaded film) to determine if processing is to commence. The hypothetical film order is defined to be the longest length of film based on the film to be loaded or the loaded film that uses the highest replenishment rate. Use of the hypothetical film order avoids the need to scan a code on the film or load the film into the processing machine 7 to determine if the appropriate volume of processing solution is to be dispensed. In an operation where a hypothetical film order is used, the operation would proceed to step 56 as described above. Knowing that the hypothetical film order is defined to be the longest length of film that uses the highest replenishment rate, if the residual volume of processing solution in the cartridge is greater than or equal to the volume of processing solution needed to process the longest length of film that uses the highest replenishment rate, then the processor would be reset and would await another film to be loaded for processing. When the film is loaded for processing, the method would proceed with the dispensing of the processing solutions for each process cycle. If the residual volume of processing solution in the cartridge is less than the volume of processing solution needed to process the longest length of film that uses the highest replenishment rate, then the processing operation would be rejected by not dispensing processing solution into the processing machine. At that point, a signal could be given to replace the supply cartridge with a new supply cartridge.

Thus, with the system and method of the present invention, it is assured that a supply cartridge contains an adequate volume of solution to process loaded film.

The invention has been described in detail with particular reference to certain preferred embodiments thereof, but it will be understood that variations and modifications can be effected within the spirit and scope of the invention.

What is claimed is:

1. A method of processing photographic material, the method comprising the steps of:

loading a processing solution cartridge onto a processing machine;

transferring first information indicative of a residual volume of processing solution in said cartridge to the processing machine;

loading a film to be processed onto said processing machine;

transferring second information about the loaded film to be processed to said processing machine;

determining a volume of processing solution needed to process the loaded film based on the transferred second information;

dispensing the volume of processing solution needed to process the loaded film into the processing machine to process the loaded film;

adjusting the residual volume of processing solution in said cartridge by subtracting the dispensed volume of processing solution from the residual volume to provide for an adjusted residual volume; and updating said first information based on said adjusted residual volume.

2. A method according to claim 1, wherein said step of transferring the first information indicative of the residual volume of processing solution in said cartridge to the processing machine comprises:

providing a code on said cartridge which includes said first information and a reader on said processing machine which reads said code.

3. A method according to claim 2, wherein said step of providing a code on said cartridge which includes said first information and a reader on said processing machine which reads said code comprises providing a bar code on said cartridge and a bar code reader on said processing machine which reads said code.

4. A method according to claim 2, wherein said step of providing a code on said cartridge which includes said first information and a reader on said processing machine which reads said code comprises providing an RF transponder on said cartridge and a RF transceiver on said processing machine which reads said code.

5. A method according to claim 1, wherein said step of transferring the second information about the loaded film to be processed to said processing machine comprises reading a film identification on the film.

6. A method according to claim 1, wherein said second information includes at least film format and film length information of said loaded film.

7. A method of processing photographic material, the method comprising the steps of:

loading a processing solution cartridge onto a processing machine;

transferring first information indicative of a residual volume of processing solution in said cartridge to the processing machine;

loading a film to be processed onto said processing machine;

transferring second information about the loaded film to be processed to said processing machine;

determining a volume of processing solution needed to process the loaded film based on the transferred second information; and determining if the residual volume of processing solution in said cartridge is greater than or equal to the volume of processing solution needed to process the loaded film;

wherein:

if the residual volume of processing solution in said cartridge is greater than or equal to the volume of processing solution needed to process the loaded film, the method further comprises the step of dispensing the volume of processing solution needed to process the loaded film into the processing machine to process the loaded film; and if the residual volume of processing solution in said cartridge is less than the volume of processing solution needed to process the loaded film, the method further comprises the step of rejecting a processing operation of the loaded film by not dispensing processing solution into the processing machine.

8. A method according to claim 7, wherein:

after said dispensing step, the method further comprises:

adjusting the residual volume of processing solution in said cartridge by subtracting the dispensed volume of processing solution from the residual volume to provide for an adjusted residual volume; and after said rejecting step, the method further comprises:

supplying a signal to indicate that a new supply cartridge is needed.

9. A method according to claim 7, wherein said step of transferring the first information indicative of the residual volume of processing solution in said cartridge to the processing machine comprises:

providing a code on said cartridge which includes said first information and a reader on said processing machine which reads said code.

10. A method according to claim 9, wherein said step of providing a code on said cartridge which includes said first information and a reader on said processing machine which reads said code comprises providing a bar code on said cartridge and a bar code reader on said processing machine which reads said code.

11. A method according to claim 9, wherein said step of providing a code on said cartridge which includes said first information and a reader on said processing machine which reads said code comprises providing an RF transponder on said cartridge and a RF transceiver on said processing machine which reads said code.

12. A method according to claim 7, wherein said step of transferring the second information about the loaded film to be processed to said processing machine comprises reading a film identification on the film.

13. A method according to claim 7, wherein said second information includes at least film format and film length information of said loaded film.

14. A method according to claim 8, comprising the further step of removing said cartridge and altering said first information so as to make said first information unreadable when the residual volume of processing solution in said cartridge is less than the volume of processing solution needed to process the loaded film.

15. A method according to claim 14, wherein said step of making said first information unreadable comprises writing over the first information.

16. A method according to claim 14, wherein said step of making said first information unreadable includes defacing said first information.

17. A method according to claim 14, wherein said step of making said first information unreadable includes providing an Rf transceiver to over-write the first information.

18. A processing system comprising:

a processing machine for processing photographic film therein, said processing machine having a code reader;

a control system for controlling operation of the processing machine, said control system being adapted to at least determine a volume of processing solution needed to process a unit amount of photographic film which is to be processed in said processing machine; and a solution supply cartridge for supplying processing solution to said processing machine to process the photographic film, said cartridge having a code thereon which includes information indicative of a residual volume of processing solution in said cartridge, such that an association of said supply cartridge with said processing machine permits the code reader on the processing machine to read the code on the supply cartridge to cause a transfer of the information indicative of the residual volume of processing solution in said cartridge to the control system;

wherein said control system is further adapted to dispense the volume of processing solution needed to process the unit amount of film to be processed in said processing machine, if the residual volume of processing solution in said cartridge is greater than or equal to the volume of processing solution needed to process the unit amount of film to be processed in said processing machine; and reject a processing operation of the unit amount of film by not dispensing processing solution into the processing machine, if the residual volume of processing solution in said cartridge is less than the volume of processing solution needed to process the unit amount of film.

19. A processing system according to claim 18, wherein:

said control system adjusts the residual volume of processing solution in said cartridge when the volume of processing solution needed to process the unit amount of film has been dispensed by subtracting the dispensed volume of processing solution from the residual volume to provide for an adjusted residual volume; and said control system is adapted to provide a signal indicating that a new cartridge is needed when the residual volume of processing solution in said cartridge is less than the volume of processing solution needed to process the unit amount of film.

20. A processing system according to claim 18, further comprising:

a film type reader for reading a film identification on the unit amount of film which is to be processed in said processing machine and providing film information to said control system, said film information comprising at least film format information and film length information for the unit amount of film.

21. A method of processing photographic material, the method comprising the steps of:

loading a processing solution cartridge onto a processing machine;

transferring first information indicative of a residual volume of processing solution in said cartridge to the processing machine;

loading a film to be processed onto said processing machine;

transferring second information about the loaded film to be processed to said processing machine;

determining a volume of processing solution needed to process the loaded film based on the transferred second information; and controlling a processing of the loaded film in the processing machine based on the volume of processing solution needed to process the loaded film.

22. A processing system comprising:

a processing machine for processing photographic film therein, said processing machine having a code reader;

a control system for controlling operation of the processing machine, said control system being adapted to at least determine a volume of processing solution needed to process a unit amount of photographic film which is to be processed in said processing machine; and a solution supply cartridge for supplying processing solution to said processing machine to process the photographic film, said cartridge having a code thereon which includes information indicative of a residual volume of processing solution in said cartridge, such that an association of said supply cartridge with said processing machine permits the code reader on the processing machine to read the code on the supply cartridge to cause a transfer of the information indicative of the residual volume of processing solution in said cartridge to the control system;

wherein said control system is further adapted to control a processing of the film in said processing machine based on the volume of processing solution needed to process the unit amount of film in said processing machine.

23. A method of processing photographic material, the method comprising the steps of:

loading a processing solution cartridge onto a processing machine;

transferring first information indicative of a residual volume of processing solution in the cartridge to the processing machine;

loading a film to be processed into the processing machine; and transferring second information about the loaded film to be processed to the processing machine;

wherein:

if the residual volume of processing solution in the cartridge is greater than or equal to a volume of processing solution needed to process a longest length of the loaded film that uses a highest replenishing rate, the method further comprises dispensing the needed volume of processing solution; and if the residual volume of processing solution in the cartridge is less than the volume of processing solution needed to process the longest length of the loaded film that uses the highest replenishing rate, the method further comprises the step of rejecting a processing operation of the loaded film by not dispensing processing solution into the processing machine.

24. A method of processing photographic material, the method comprising the steps of:

loading a processing solution cartridge onto a processing machine;

transferring information indicative of a residual volume of processing solution in the cartridge to the processing machine; and determining a volume of processing solution needed to process a hypothetical film length based on a film which is to be loaded on the processing machine;

wherein:

if the residual volume of processing solution in the cartridge is greater than or equal to the determined volume of processing solution, then the processing machine awaits a film to be loaded for processing; and if the residual volume of processing solution in the cartridge is less than the determined volume of processing solution, the method further comprises the step of rejecting a processing operation of the film.

* * * * *